US007566140B2

(12) United States Patent
Sevilla

(10) Patent No.: US 7,566,140 B2
(45) Date of Patent: Jul. 28, 2009

(54) SELF ILLUMINATING BELT BUCKLE

(76) Inventor: Frederick J. Sevilla, 15055 W. Melvin St., Goodyear, AZ (US) 85338

( * ) Notice: Subject to any disclaimer, the term of this patent is extended or adjusted under 35 U.S.C. 154(b) by 15 days.

(21) Appl. No.: 11/223,667

(22) Filed: Sep. 9, 2005

(65) Prior Publication Data

US 2007/0058361 A1 Mar. 15, 2007

(51) Int. Cl.
*F21V 21/08* (2006.01)

(52) U.S. Cl. ..... 362/108; 362/103; 362/806; 362/104; 362/191

(58) Field of Classification Search ..... 362/103–104, 362/108, 570–571, 555, 565, 800, 191, 806; 40/442–444, 542–546; D2/627–640; 24/163 K, 24/163 R See application file for complete search history.

(56) References Cited

U.S. PATENT DOCUMENTS

| | | | | | |
|---|---|---|---|---|---|
| 2,854,563 | A | | 9/1958 | Catching | |
| 3,931,689 | A | * | 1/1976 | Shine | 40/570 |
| 4,101,955 | A | * | 7/1978 | DuNah | 362/104 |
| 4,605,882 | A | * | 8/1986 | DeLuca | 315/158 |
| 5,183,324 | A | | 2/1993 | Thomas | |
| 5,193,896 | A | | 3/1993 | Oberlander | |
| 5,195,220 | A | * | 3/1993 | Herman | 24/113 R |
| 5,388,357 | A | * | 2/1995 | Malita | 40/570 |
| 5,428,912 | A | * | 7/1995 | Grondal et al. | 40/570 |
| 5,542,157 | A | * | 8/1996 | Herman | 24/113 MP |
| 5,755,506 | A | * | 5/1998 | Ray et al. | 362/103 |
| 5,871,271 | A | * | 2/1999 | Chien | 362/106 |
| 6,098,252 | A | * | 8/2000 | Woerth, Jr. | 24/163 R |
| 6,805,460 | B1 | | 10/2004 | Zoller | |
| 2004/0195281 | A1 | | 10/2004 | Hung | |
| 2004/0221497 | A1 | * | 11/2004 | Launey | 40/544 |
| 2004/0257817 | A1 | * | 12/2004 | Philipp | 362/363 |
| 2005/0286257 | A1 | * | 12/2005 | Trimmer et al. | 362/485 |
| 2006/0133083 | A1 | * | 6/2006 | Gelbert | 362/250 |

OTHER PUBLICATIONS

Website h://www.bodycandy.com/cgi-bin/item/BUCK-1009 (printed May 15, 2007).*

Website www.metalsdepot.com/products/alum2.phtml?phtml?page=tread&LimAcc=&aident= Diamond Plate Trademark printed May 17, 2007).* www.newpig.com pritned out May 19, 2007 (Diamond Plate trademerk).*

"Symbols and Their Meaning" http://www.radioliberty.com/Symbolsandtheirmeaning.html.*

Webster's New World Dictionary, Second College Edition, 1976, p. 1442, The World Publishing Company.

* cited by examiner

*Primary Examiner*—Jacob Y Choi
*Assistant Examiner*—Robert May
(74) *Attorney, Agent, or Firm*—Schmeiser, Olsen & Watts LLP

(57) ABSTRACT

A self illuminated belt buckle comprising a housing with a symbol shaped opening in the front and an opening in the bottom of the housing. The housing containing at least one power source, and at least one light source such as an LED which may be connected to a switch. The at least one power source providing power to the light source which provides background lighting through the symbol shaped opening and through the opening in the bottom of the housing. The light source and power source not being visible from outside of the housing. The housing further being connected to an attachment device such as a belt buckle or brooch pin. The housing also being formed from diamond plate.

4 Claims, 5 Drawing Sheets

SELF ILLUMINATING BELT BUCKLE

BACKGROUND OF THE INVENTION

1. Technical Field

This invention relates to a belt buckle which has an illuminated symbol and an opening which creates a similar effect to that produced by neon lights attached to the undercarriage of a car.

2. Background Art

In many parts of the United States and abroad the latest fashion craze is anything bright, shiny and flashy. This has created a fashion trend that utilizes all of the latest high tech developments in order to create the most attention grabbing accessories.

Examples of accessories which utilize technology and have previously been patented include Oberlander U.S. Pat. No. 5,193,896 ("Oberlander"). The Oberlander patent discloses a lighting device for personal use that is worn on the wrist like a watch and provides a light source. Zoller et al. U.S. Pat. No. 6,805,460 discloses a flashlight which is attached to a dog's collar. The dog collar of Zoller shines light on the path in front of and surrounding the dog in order to illuminate any obstacles that might be in the way. U.S. Pat. No. 5,183,324 issued to Thomas describes a lighting accessory worn on a belt. The lighting accessory acts as a flash light with a beam that is directable depending on what the user wants to have illuminated.

Other patents that have issued deal more with accessories and the like. For example, U.S. Pat. No. 2,854,563 issued to J. W. Catching illustrates illuminated jewelry which has lights which extend from the front of the jewelry. U.S. Pat. No. 5,363,291 issued to Steiner depicts a portable light assembly which can be attached to a hat, clothing or the like in order to illuminate a logo. Basically, Steiner is a small attachable spotlight that provides focus on whatever it is illuminating.

None of these patents, however, illustrate a self illuminating belt buckle or insignia in which the light is placed behind an insignia in order to provide a background glow.

Accordingly, what is needed is a self illuminating belt buckle or insignia which uses light to provide a background glow behind an insignia or design.

DISCLOSURE OF THE INVENTION

The present invention may be readily adapted for use with a wide variety of fashion accessories. Embodiments of the present invention may provide, among other benefits: an accessory with a backlit symbol or insignia which has a self contained power source.

The present invention consists of a housing containing a power source which is workably coupled to at least one light source. The housing having a symbol or insignia cut into it and the light source producing back lighting for the symbol. The housing may be connected to a buckle or other accessory attachment device which allows the user to use the housing as a belt buckle or other accessory. The housing may also have an opening in the bottom which allows the light source to shine through providing an effect similar to that produced when neon lights are attached to the undercarriage of a car.

The foregoing and other features and advantages of the invention will be apparent to those of ordinary skill in the art from the following more particular description of the invention and the accompanying drawings.

BRIEF DESCRIPTION OF THE DRAWINGS

The invention will hereinafter be described in conjunction with the appended drawings where like designations denote like elements, and.

DESCRIPTION OF THE INVENTION

As discussed above, embodiments of the present invention relate to a self illuminating belt buckle or accessory.

Figure 1:
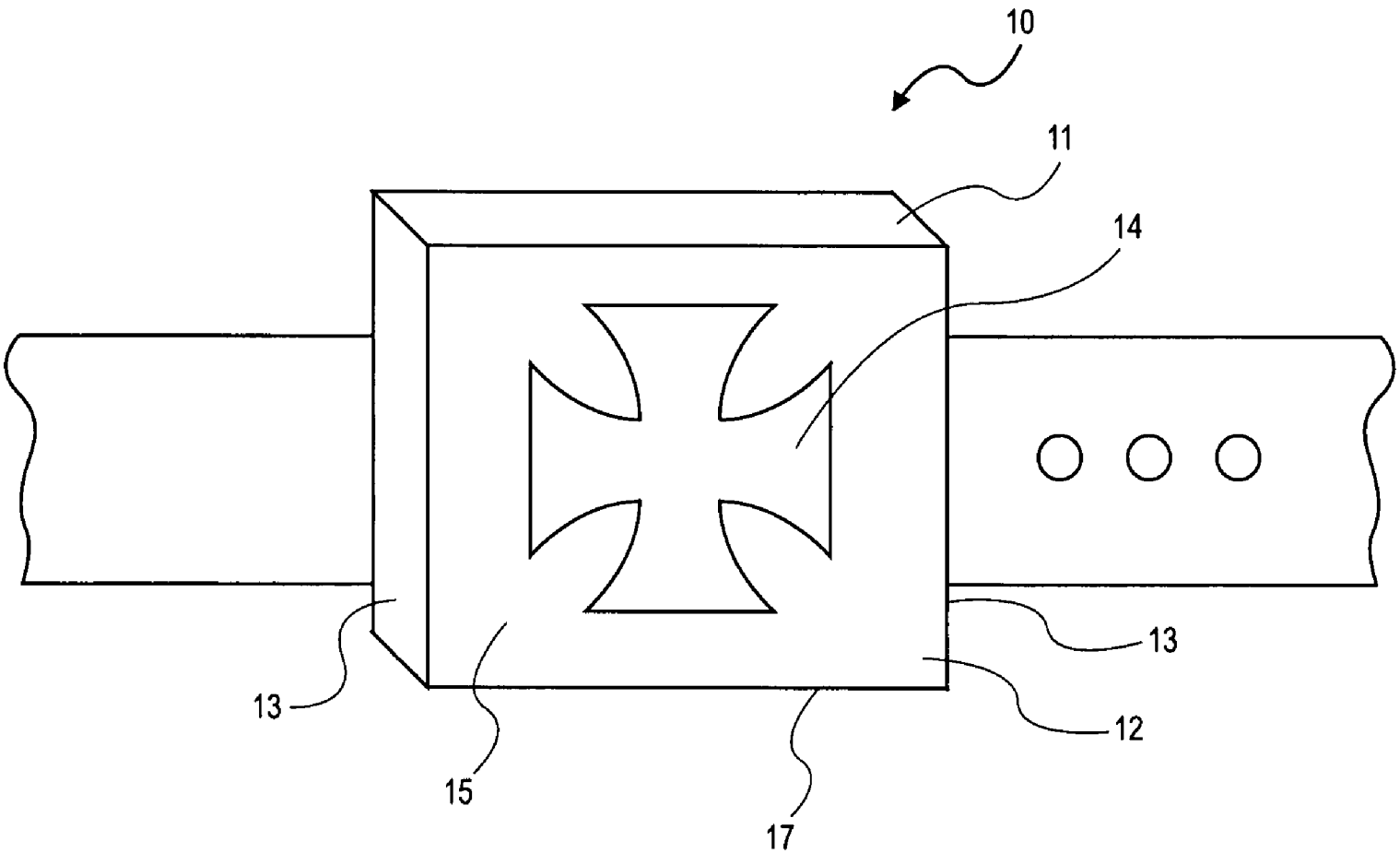
FIG. 1 is a front view of a self illuminating belt buckle configured according to an embodiment of the present invention.
Figure 3:
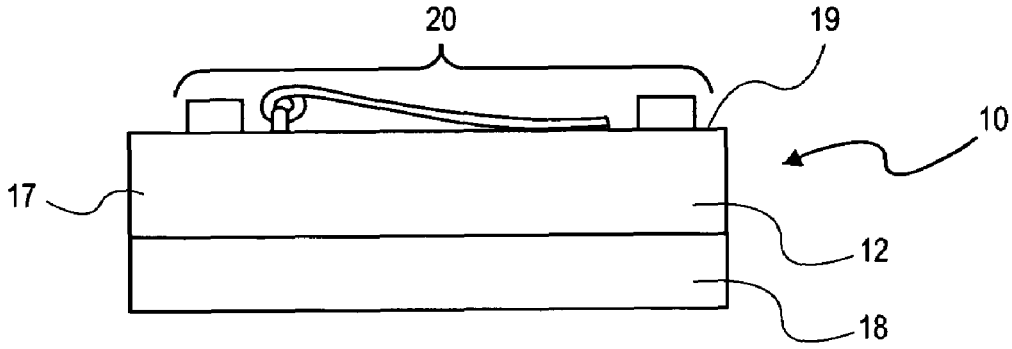
FIG. 3 is a bottom view of a self illuminating belt buckle configured according to an embodiment of the present invention.
Figure 5:
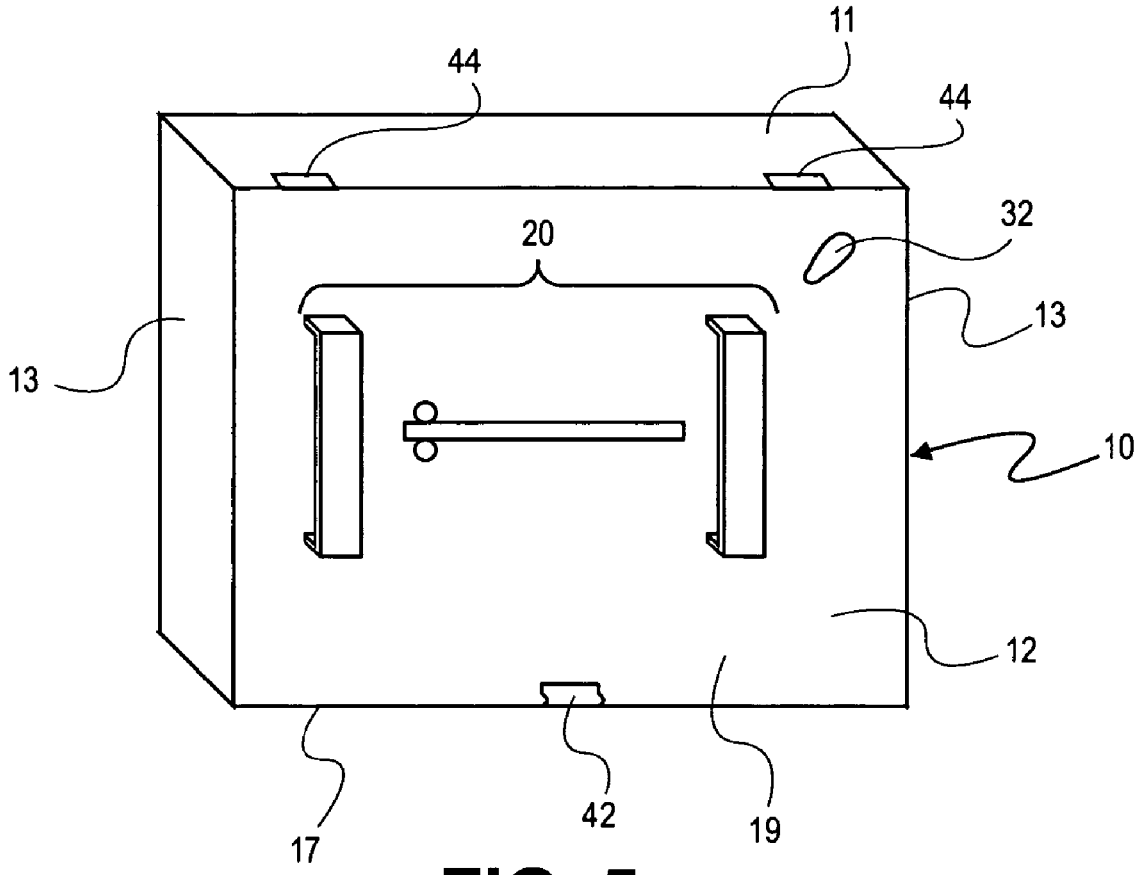
FIG. 5 is a back view of a self illuminating belt buckle configured according to an embodiment of the present invention.
Figure 6:
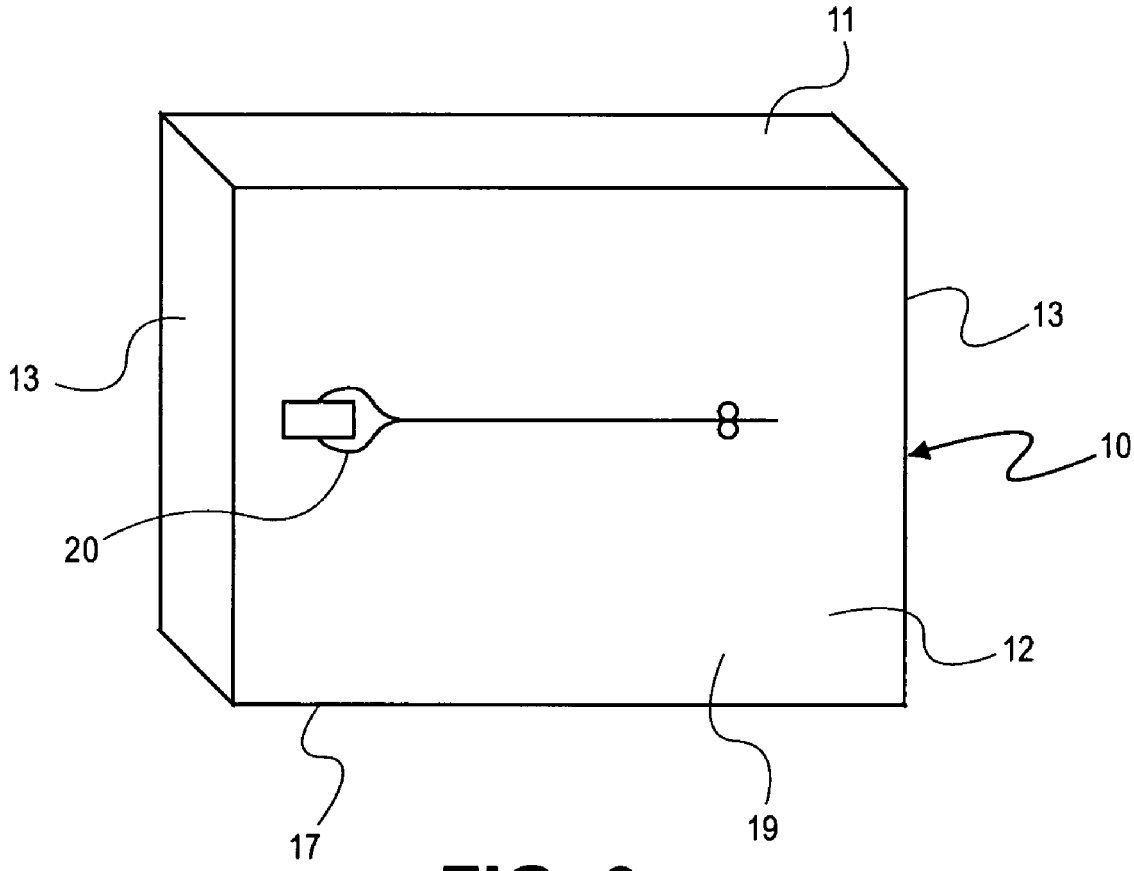
FIG. 6 is a back view of a self illuminating insignia configured according to an embodiment of the present invention.

FIG. 1 illustrates a self illuminating belt buckle configured according to an embodiment of the present invention. The self illuminating belt buckle 10 comprises a housing 12. The housing 12 may consist of a top 11, bottom 17, front 15, back 19 (as seen in FIGS. 5 and 6) and two side pieces 13. Though several of these pieces may be formed from a single section of material. The pieces of the housing 12 may be connected in any way that provides the desired effect and the strength required for a self illuminating belt buckle 10, such as welding or the like. The bottom piece of the housing may have an opening 18 in it as shown in FIG. 3.

As shown in FIG. 1, the front of the housing may have an opening formed in the shape of a symbol or insignia 14. As shown in the figure, the symbol or insignia 14 shaped opening is a non-occluded, logo shaped opening. Preferable symbols or insignia 14 include common trademarks or other symbols associated with pop culture. It is also possible that the user's name may be formed in the front of the housing.

The symbol or insignia 14 opening may be formed by cutting the symbol out of the housing. It also may be formed during the creation of the housing, in particular if the housing is molded from plastic or other moldable material. If the symbol or insignia 14 opening is formed during a molding process, then the mold may be designed to simply leave the symbol or insignia 14 opening in the housing material instead of requiring that the symbol or insignia 14 opening be cut into the housing material. The symbol or insignia 14 opening may be formed in the housing by any means possible that does not weaken the housing to the point that it cannot serve its purpose. Various front pieces 15 each containing a different symbol 14 could be removably securable to the housing 12.

Figure 2:
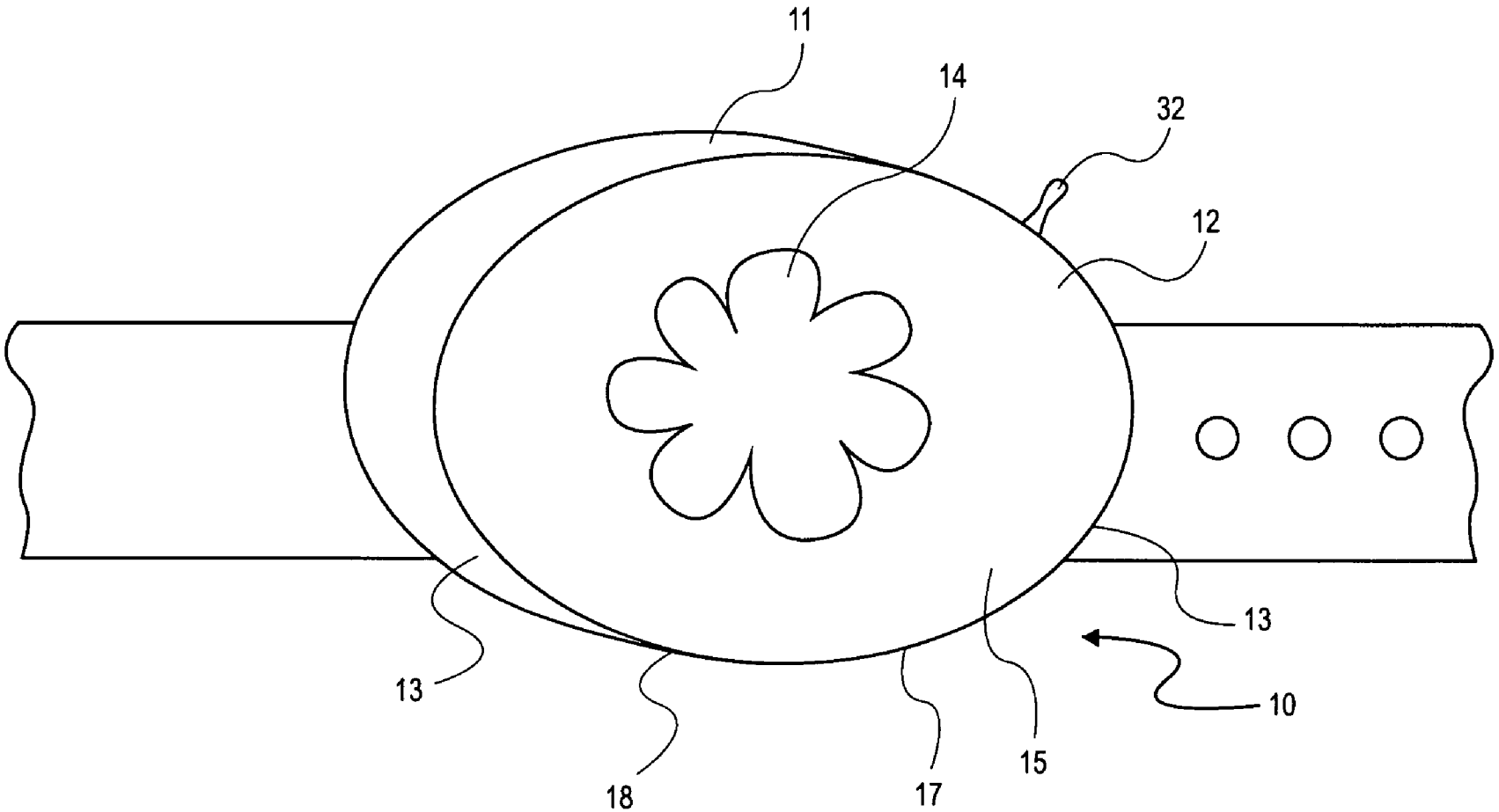
FIG. 2 is a front view of a self illuminating belt buckle configured according to a second embodiment of the present invention.

The housing 12 may be formed in any shape desirable such as squares, rectangles, circles, ovals and the like as seen in FIG. 2. Therefore, the housing 12 may not have a definite top 11, bottom 17, front 15, back 19 (FIGS. 5 and 6) and two side pieces 13, but instead may have general areas. These general areas include a general top 11 of the housing 12, a general bottom 17 area, a general front 15 area, a general back 19 area, and at least two general side 13 areas. Though, it is possible that some of the areas may be more definite than others. It is also possible that there may be other members or general areas in situations where the housing 12 is an octagon or other shape with more than four edges.

The housing 12 may be formed from any material which will hold its shape and which is strong enough to attach to a belt buckle or other accessory attachment device. One material which may be used is diamond plate which is strong and yet provides a very shiny surface for aesthetics. The housing 12 may also be formed from any type of light weight metal such as copper or aluminum. It may also be formed from plastics. Plastics with embedded printing, jewels or with coatings to create special effects may also be used.

As illustrated in FIG. 3, the housing 12 may contain an opening 18 in its bottom 17. The opening 18 allows light from the self illuminated belt buckle 10 to travel downward providing an effect similar to that created when neon lights are attached to the undercarriage of a car. The opening 18 may take up part of the bottom piece 17 as seen in FIG. 3 or else the bottom piece 17 may simply be missing from the housing 12, providing a larger opening. Opening 18 could also be configured with any desirable design.

The opening 18 and the symbol 14 (as shown in FIG. 1) may be covered with a plastic or other transparent or translucent material. Any such covering could also be tinted to provide color or otherwise designed to provide a desired effect.

As illustrated in FIGS. 5 and 6, the housing 12 is also attached to an attachment device 20 such as a belt buckle, a pin or other device which allows the self illuminated belt buckle 10 to be used as an accessory. The attachment device 20 typically attaches to the back of the housing 19. The attachment device 20 may be attached to the housing 12 in any way which provides enough strength to prevent the housing 12 from coming loose from the attachment device 20 when in use. The attachment device 20 should also be strong enough to support the housing 12 when the self illuminating belt buckle 10 is being worn. Attachment devices 20 may include belt buckles, sticky backs, pins such as those used for broaches or the like.

Figure 4:
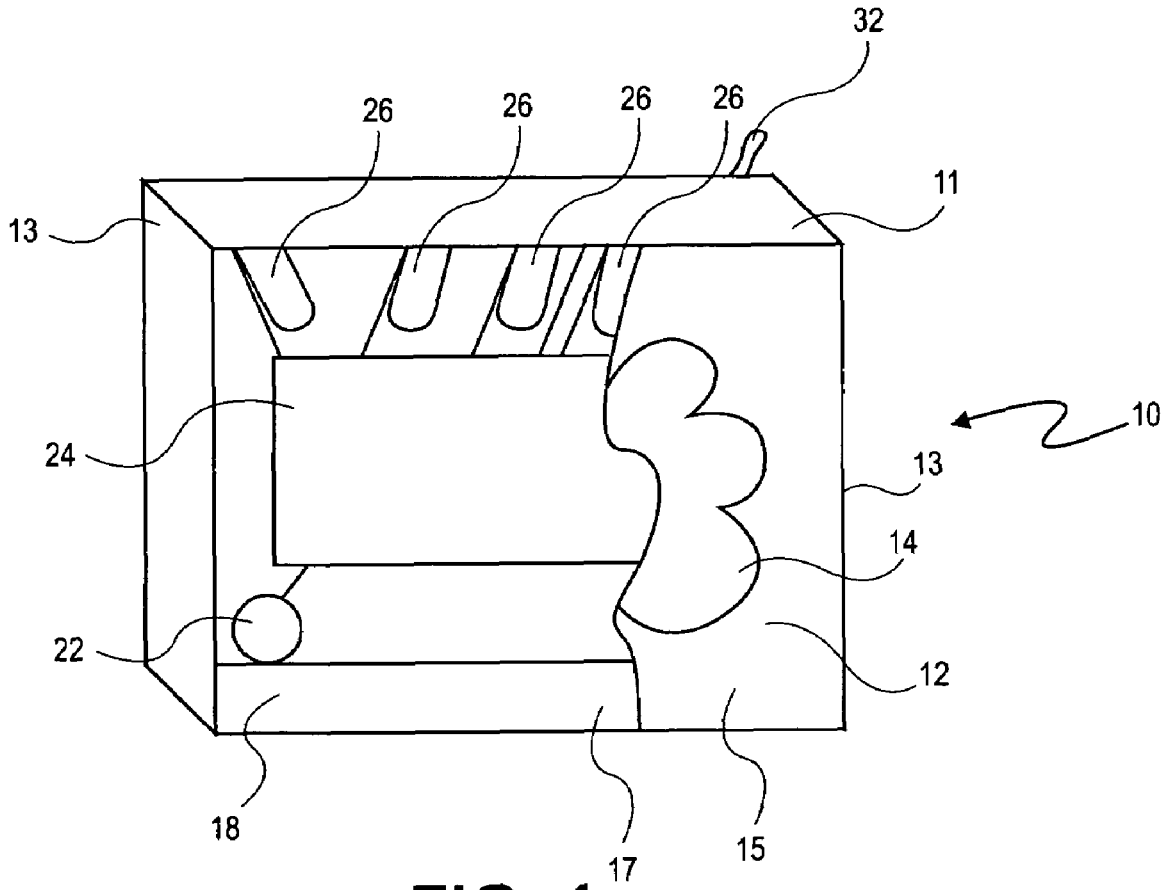
FIG. 4 is a front view, partially in section, of a self illuminating belt buckle configured according to an embodiment of the present invention.

FIG. 4 depicts the inside of the housing 12. The housing 12 contains a power source 22 which provides power to the self illuminating belt buckle 10. The power source 22 may be any device which provides enough power to allow the belt buckle to operate for a reasonable time. The power source 22 should also be light weight enough to prevent the self illuminating belt buckle 10 from becoming too cumbersome. Potential power sources 22 include watch batteries which are small and light weight, other standard batteries, provided only a couple of the batteries are required to provide the necessary power, and the like. It is also possible that the power source 22 may be a solar cell which would be attached to the outside of the housing and would provide power to the self illuminating belt buckle 10 from energy stored from sunlight. If the power source 22 is placed inside the housing 12, it should be placed where it is not visible from the outside of the housing 12 through the symbol 14 opening.

The power source 22 is workably coupled 24 to at least one light source 26. The workable coupling 24 may be any sort of connection which allows the power source 22 to provide power to the light source 26. The workable coupling 24 may be accomplished according to the common practice in the art.

The at least one light source 26 is placed within the housing 12. Preferably, the light sources 26 are placed so that they cannot be directly seen from outside the housing 12 through the symbol 14 opening. Because of this, the light sources 26 create a background lighting effect through the symbol 14.

The light sources 26 may be any color or brightness desired. For instance, it may be desirable to use a red or a blue light source 26 in order to give the self illuminating belt buckle 10 a red or a blue glow. Any brightness of light sources 26 or number of light sources 26 may also be used in the self illuminating belt buckle 10 depending on the effect desired by the user. For instance, a brighter light source 26 may be desirable if the belt buckle 10 is to be worn in areas that are well lit. Belt buckles 10 that are to be worn in darker areas such as clubs and the like may use dimmer light sources 26. It is also possible that a controller may be workably coupled to the light sources 26 which can be used to alter the brightness of the light sources 26. The controller may also be configured to automatically control the brightness of the light sources 26.

Many different types of light sources 26 may be used to create the desired effect. For example, the light source 26 may be a small standard light bulb, a neon light, an LED or the like. The LED is the preferred light source 26 as LEDs come in many colors and do not burn out and will therefore never need to be replaced.

The light source 26 and the power source 22 may be workably coupled to a switch 32. The light source 26 and power source 22 may be workably coupled in any way that allows the switch 32 to control whether or not the light source 26 is turned on. The light source 26 and power source 22 may be workably coupled according to the common practice in the art.

The switch 32 may be placed either outside or inside the housing 12. The switch 32 allows the user to turn the light source 26 on and off and thereby conserve the power source 22. The switch 32 may be any type of device which would turn the light source 26 on and off such as a rocker switch, toggle switch, slide switch or the like. The switch 32 may also have dimming capabilities allowing the user to adjust the brightness of the light source 26. Preferably the switch 32 will be small enough that it is not highly noticeable by someone looking at the self illuminating belt buckle 10.

As illustrated in FIG. 5, the back 19 of the housing 12 may open in order to allow the user to get inside the housing 12. This is useful if the switch is inside of the housing 12 or if the power source or light source need to be adjusted or replaced. The back 19 of the housing 12 may open on hinges 44 and may have a latch 42 at the bottom of the back 19 in order to lock the back 19 closed when the self illuminating belt buckle is in use. The back 19 of the housing 12 may open in many different ways including sliding on and off, opening on hinges, popping in and out of place or the like. Preferably, the back 19 of the housing 12 opens easily and closes securely in place. It is also possible that other pieces of the housing 12 may open instead or along with the back 19.

Accordingly, for the exemplary purposes of this disclosure, the components defining any embodiment of the invention may be formed as one piece if it is possible for the components to still serve their function. The components may also be composed of any of many different types of materials or combinations thereof that can readily be formed into shaped objects provided that the components selected are consistent with the intended mechanical operation of the invention.

The embodiments and examples set forth herein were presented in order to best explain the present invention and its practical applications and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims. Accordingly, any components of the present invention indicated in the drawings or herein are given as an example of possible components and not as a limitation.

The invention claimed is:

1. A self illuminating belt buckle comprising:

a housing comprising a front, a back, a top, a bottom and two side pieces;

the housing further comprising a non-occluded, logo shaped opening in the front of the housing, wherein the bottom of the housing further comprises an additional opening for emitting light in a downward direction relative to the housing;

at least one power source workably coupled to at least one light source, wherein the power source and the at least one light source are placed within the housing, the at least one power source being placed where it is not visible from outside the housing;

wherein the at least one light source is coupled to the top of the housing and is not visible from outside the housing, the at least one light source providing backlighting for the non-occluded, logo shaped opening and emitting light through the additional opening in a downward direction so that when the belt buckle is worn by a user, the logo is illuminated as well as an area below the belt buckle for an ornamental effect;

a switch workably coupled to the light source; and a buckle coupled to the back of the housing.

2. The self illuminating belt buckle of claim 1, wherein the at least one light source is an LED.

3. The self illuminating belt buckle of claim 1, wherein light from the at least one light source is visible from outside of the housing.

4. The self illuminating belt buckle of claim 1, wherein a controller is workably coupled to the at least one light source which automatically controls the brightness of the light source.

* * * * *

UNITED STATES PATENT AND TRADEMARK OFFICE

CERTIFICATE OF CORRECTION

PATENT NO. : 7,566,140 B2
APPLICATION NO. : 11/223667
DATED : July 28, 2009
INVENTOR(S) : Frederick J. Sevilla, II It is certified that error appears in the above-identified patent and that said Letters Patent is hereby corrected as shown below:

Title Page item 76
The inventor name should read --Frederick J. Sevilla II--

Signed and Sealed this

First Day of December, 2009

David J. Kappos

David J. Kappos
*Director of the United States Patent and Trademark Office*